US010961682B1

(12) United States Patent
Williams

(10) Patent No.: US 10,961,682 B1
(45) Date of Patent: Mar. 30, 2021

(54) SYSTEM AND METHODS FOR CONCRETE SLAB FOUNDATION REPAIR

(71) Applicant: John Dustin Williams, New Braunfels, TX (US)

(72) Inventor: John Dustin Williams, New Braunfels, TX (US)

( * ) Notice: Subject to any disclaimer, the term of this patent is extended or adjusted under 35 U.S.C. 154(b) by 0 days.

(21) Appl. No.: 16/742,522

(22) Filed: Jan. 14, 2020

(51) Int. Cl.
*E02D 3/12* (2006.01)
*E02D 31/10* (2006.01)
*E02D 35/00* (2006.01)

(52) U.S. Cl.
CPC ..... *E02D 31/10* (2013.01); *E02D 3/12* (2013.01); *E02D 35/005* (2013.01); *E02D 2250/003* (2013.01); *E02D 2250/0038* (2013.01); *E02D 2300/002* (2013.01); *E02D 2300/0006* (2013.01)

(58) Field of Classification Search
CPC ..... E02D 3/12; E02D 3/10; E02D 2300/002; E02D 2250/003; E02D 35/005; E02D 2250/0038; E02D 2300/0006
See application file for complete search history.

(56) References Cited

U.S. PATENT DOCUMENTS 3,739,594 A * 6/1973 Freese ..... B01D 53/26 62/93
5,428,963 A * 7/1995 Korycki ..... B01D 8/00 62/272
5,904,447 A * 5/1999 Sutton ..... B09C 1/00 175/323
5,979,879 A 11/1999 Asplin
5,988,947 A 11/1999 Bruso
6,457,905 B1 * 10/2002 Nickell ..... B09C 1/00 111/7.4
6,976,804 B1 12/2005 Asplin
(Continued)

FOREIGN PATENT DOCUMENTS

CA 2808969 9/2014
CN 107419646 A 12/2017
(Continued)

OTHER PUBLICATIONS

Gates, William C. B., "Protection of Ground-Water Monitoring Wells Against Frost Heave" *Environmental and Engineering Geoscience* 1989, xxvi (2), 241-251.
(Continued)

*Primary Examiner* — Carib A Oquendo
(74) *Attorney, Agent, or Firm* — Norton Rose Fulbright US LLP

(57) ABSTRACT

The present disclosure includes systems, devices, and methods for correcting foundation heave. Some systems may include a compressed air source configured to propel air having a relative humidity that is less than or equal to 30 percent and one or more air injection devices each configured to be disposed within an earth formation to deliver the air. Some air injection devices include an elongated body having: a length that is greater than or equal to 3 feet, a sidewall that defines a conduit extending along a longitudinal axis of the elongated body, the conduit being configured to be in fluid communication with the compressed air source, and a plurality of perforations, each extending through the sidewall and in fluid communication with the conduit.

27 Claims, 4 Drawing Sheets

(56) References Cited

U.S. PATENT DOCUMENTS

| | | | | |
|---|---|---|---|---|
| 7,011,475 | B2 * | 3/2006 | Shiraishi | E01C 3/04 405/302.4 |
| 8,186,907 | B1 | 5/2012 | Asplin | |
| 8,844,240 | B2 * | 9/2014 | Kuchel | C09K 17/30 405/269 |
| 9,828,740 | B1 * | 11/2017 | Brown | E02D 31/02 |
| 10,138,641 | B2 * | 11/2018 | Tabatabai | E02D 37/00 |
| 2003/0207440 | A1 * | 11/2003 | Smith | B09C 1/002 435/266 |
| 2004/0175242 | A1 * | 9/2004 | Kim | E02D 3/126 405/269 |
| 2008/0304919 | A1 | 12/2008 | Coyle | |
| 2009/0304457 | A1 * | 12/2009 | Shimada | C09K 17/06 405/269 |
| 2014/0290169 | A1 | 10/2014 | McCuen | |
| 2018/0209113 | A1 * | 7/2018 | Birtele | E02D 3/12 |
| 2019/0255583 | A1 * | 8/2019 | Keramida | C01B 13/10 |

FOREIGN PATENT DOCUMENTS

| | | |
|---|---|---|
| CN | 107419646 B | 7/2019 |
| FR | 2991891 | 12/2013 |

OTHER PUBLICATIONS

Nelson et al., "Calculation of Heave of Deep Pier Foundations" *Geotechnical Engineering Journal of the SEAGS & AGSSEA* 2012, 43(1), 12-25.

Yoshida et al., "The prediction of total heave of a slab-on-grade floor on Regina clay" Can. *Geotech. J.* 1983, 20, 69-81.

* cited by examiner

SYSTEM AND METHODS FOR CONCRETE SLAB FOUNDATION REPAIR

FIELD OF INVENTION

The present invention relates generally to foundation repair, and more specifically, to methods and systems for repair and prevention of foundation heave.

BACKGROUND

Foundation heave occurs when a foundation, such as a concrete slab, is forced upward by the expansion of an earth formation (e.g., soil) or other forces acting underneath the foundation. Typically, heave occurs due to soil expansion underlying the foundation. For example, heave may occur due to unwanted water, or other liquid, accumulating in the soil from precipitation, plumbing leakage, broken water lines, or other sources. Expansive soil types, such as clay, and colder environments may exacerbate foundation heave, leading to increased forces acting on the foundation. Soil expansion can cause a central portion of the foundation slab to heave (e.g., doming slab heave) and/or cause the edges of the foundation slab to heave (e.g., dishing slab heave). Such expansion forces can create differential movement of the foundation resulting in excessive bending, torsional, and/or shear stress being applied to the foundation or supported structure. Differential foundation movement can also lead to excessive slopes or tilt of the structure.

Differential movement of the foundation can lead to critical structural damage to the foundation itself and/or any structure supported by the foundation. Differential movement of the foundation can also lead to excessive cosmetic distress to architectural surfacings and/or excessive functional distress (e.g. doors racking) thereby affecting the usability of the structure. Thus, there is a need to alleviate soil expansion to reduce or prevent excessive structural distress, excessive cosmetic distress, and/or excessive functional distress due to uneven movement of the foundation.

SUMMARY

Some embodiments of the present systems (e.g., for correcting foundation heave) comprise a compressed air source configured to propel air having a relative humidity that is less than or equal to 30 percent; and one or more air injection devices, at least one of which includes an elongated body configured to be disposed within an earth formation, the elongated body comprising: a length that is greater than or equal to 3 feet; and a sidewall that defines: a conduit extending along a longitudinal axis of the elongated body, the conduit configured to be in fluid communication with the compressed air source such that the conduit receives air propelled by the compressed air source; and a plurality of perforations, each extending through the sidewall and in fluid communication with the conduit.

In some embodiments, the relative humidity of the air propelled by the compressed air source is less than or equal to 5.0 percent.

In some embodiments, a ratio of the length of the elongated body to a maximum transverse dimension of the conduit is greater than or equal to 100. In some embodiments, the at least one of the one or more air injection devices comprises one or more helical blades, each coupled to an outer surface of the sidewall of the elongated body.

Some embodiments of the present systems comprise an aftercooler in fluid communication with the one or more air injection devices and configured to cool air supplied to the conduit of the at least of the one or more injection devices. In some embodiments, the aftercooler is configured to receive the air propelled by the compressed air source and is configured to supply the cooled air to the conduit of the at least one of the one or more injection devices.

Some embodiments of the present systems comprise a dry air source configured to be in fluid communication with the one or more air injection devices, the dry air source configured to reduce the relative humidity of air supplied to the conduit of the at least one of the one or more air injection devices. In some embodiments, the dry air source is configured to receive the cooled air supplied by the aftercooler and is configured to supply the air having the reduced relative humidity to the conduit of the at least one of the one or more injection devices.

Some embodiments of the present systems comprise a heat source configured to be in fluid communication with the one or more air injection devices, the heat source configured to supply air having a temperature of at least 150 degrees Fahrenheit to the conduit of the at least one of the one or more air injection devices. In some embodiments, the heat source is configured to receive the cooled air supplied by the aftercooler and is configured to supply the air having the temperature of at least 150 degrees Fahrenheit to the conduit of the at least one of the one or more injection devices. In some embodiments, the heat source is configured to receive from the dry air source the air having the reduced relative humidity and is configured to supply the air having the temperature of at least 150 degrees Fahrenheit to the conduit of the at least one of the one or more injection devices.

Some embodiments of the present methods (e.g., of correcting foundation heave) comprise positioning one or more air injection devices into an earth formation underlying a slab foundation, at least one of the one or more air injection devices comprise an elongated body having: a length that is greater than or equal to 3 feet; and a sidewall that defines: a conduit extending along a longitudinal axis of the elongated body; and a plurality of perforations, each extending through the sidewall and in fluid communication with the conduit; supplying air to the at least one of the one or more injection devices, wherein the air has a relative humidity that is less than or equal to 30 percent.

In some embodiments of the present methods, the relative humidity of the air is less than or equal to 5.0 percent. In some embodiments of the present methods, the air supplied to the at least one of the one or more injection devices has a temperature of at least 150 degrees Fahrenheit. Some embodiments of the present methods comprise heating the air supplied to the at least one of the one or more injection devices to at least 150 degrees Fahrenheit.

In some embodiments of the present methods, the air supplied to the at least one of the one or more injection devices has a pressure of at least 50 pounds per square inch gauge (psig). Some embodiments of the present methods comprise pressurizing the air supplied to the at least one of the one or more injection devices to at least 50 psig.

In some embodiments of the present methods, positioning the one or more air injection devices comprises inserting the one or more air injection devices into the formation at an insertion site that is within 15 feet of the slab foundation as measured by the shortest distance between the insertion site and the slab foundation. In some embodiments of the present methods, the one or more air injection devices are inserted into the formation at an angle between 25 and 70 degrees from a level horizontal plane.

Some embodiments of the present methods comprise supplying a stabilizing agent to the one or more injection devices such that the stabilizing agent exits the plurality of perforations defined by the injection device. In some embodiments of the present methods, the stabilizing agent is supplied to the one or more injection devices after the air is supplied.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed configuration, the term "substantially" may be substituted with "within [a percentage] of" what is specified, where the percentage includes 0.1, 1, 5, and 10 percent.

Further, an apparatus or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any configuration of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one configuration may be applied to other configurations, even though not described or illustrated, unless expressly prohibited by this disclosure or the nature of the configurations.

Some details associated with the configurations described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the configuration depicted in the figures.

DETAILED DESCRIPTION

Figure 1:
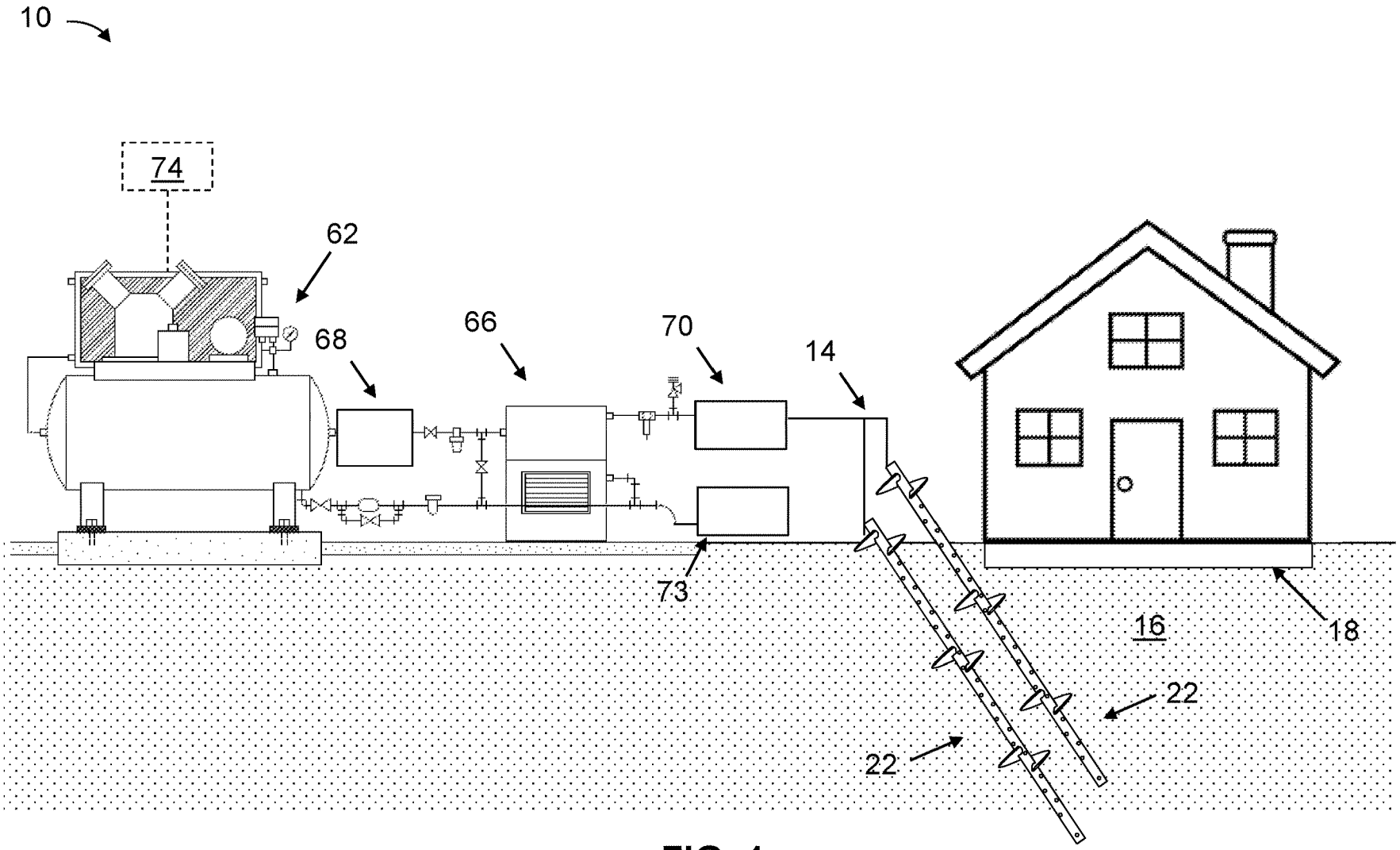
FIG. 1 is an illustrative diagram of an example of a foundation repair system.

Referring now to FIG. 1, an illustrative depiction of one embodiment of the present systems for correcting foundation heave is shown and generally designated by reference numeral 10. As shown in FIG. 1, system 10 includes one or more air injection devices 14 positionable within earth formation 16 proximate to a slab foundation 18. In this instance, such formation 16 comprises an area of soil expansion caused by an accumulation of liquid within the formation. The area of soil expansion can cause foundation 18 to exhibit heave. As disclosed herein, each air injection device 14 is configured to deliver suitable air to formation 16 in order to cause the soil expansion (e.g., beneath or proximate to foundation 18) to subside and thus reduce the heave exhibited by the foundation.

System 10 may comprise one or more appropriate components (e.g., compressed air source 62, dry air source 66, heat source 70, each discussed in further detail below) configured to supply air to air injection device(s) 14 to cause expansion areas of formation 16 to subside.

In one embodiment, system 10 comprises a dry air source 66 to dry the air delivered to formation 16. For example, dry air source 66 is configured to supply air that reduces the moisture content of the expansion areas of formation 16, and thus causes the expansion areas to subside. To that end, air output by dry air source (e.g., at an outlet of the dry air source) can comprise a relative humidity that is approximately any one of, less than any one of, or between any two of, the following: 0.01, 0.05, 0.1, 0.25, 0.5, 0.6, 0.7, 0.8, 0.9, 1.0, 1.1, 1.2, 1.3, 1.4, 1.5, 1.6, 1.7, 1.8, 1.9, 2.0, 5.0, 10, 15, 20 25, or 30 percent. It should be noted that the greater the relative humidity of the air, the longer it will take to dry out subsurface soils. Thus, air with a lower relative humidity may be more desirable for faster dry times, however air with a greater relative humidity may be suitable if drying time is not at issue.

As shown, dry air source 66 is in fluid communication with one or more air injection devices 14 (e.g., via one or more conduits) to deliver the dry air to formation 16. Dry air source 66 can comprise any suitable device or system for removing moisture content from air, thereby reducing the dew point of the air. For example, dry air source 66 can include any suitable dryer, such as for example, an aftercooler (e.g., 68), a refrigerated air dryer, a coalescing air filter, a deliquescent air dryer, a desiccant dryer (e.g., having silica gel, activated alumina, molecular sieves, or the like to absorb moisture), a membrane air dryer, a chemical dryer, a sorption dryer, and/or the like.

In the embodiment shown, system 10 includes a compressed air source 62 configured to drive air dried by the system toward air injection device(s) 14 and ultimately into formation 16 (via the air injection device(s), as described below). More particularly, compressed air source 62 may be in fluid communication with dry air source 66 (e.g., via one or more conduits) and may be configured to drive the air dried by the dry air source into formation 16.

Compressed air source 62 can be configured to supply air at any suitable pressure such as, for example, between 25 and 300 pounds per square inch gauge ("psig"), such as, for example, approximately any one of, or between approximately any two of the following: 50, 75, 100, 125, 150, 175, 200, 225, 250 and 275 psig. Compressed air source 62 can comprise any suitable device or system for supplying air at the pressures described herein, such as, for example, a container pre-filled with compressed air, an air compressor, and/or the like.

Compressed air source 62 may be configured to supply a volume air large enough to effectuate the shrinkage of formation 16 beneath a foundation (e.g., 18) of any suitable square footage. For example, compressed air source 62 may be configured to output air between approximately 100 cubic feet per minute ("CFM") and approximately 2200 CFM at 100 psig, such as, for example, at approximately any one of, or between approximately any two of the following: 500, 750, 800, 1000, 1250, 1500, 1600, 1750, and 2000 CFM at 100 psig. As shown, each injection device 14 is in fluid communication with compressed air source 62 (e.g., directly or indirectly, such as, via dry air source 66 and/or one or more other components of system 10) such that air pressurized by the compressed air source is delivered to each injection device. In some embodiments, compressed air source 62 can be portable (e.g., vehicle- or trailer-mounted) to easily move the compressed air source from various locations.

Dry air source 66 and compressed air source 62 may be positioned at any suitable position along the flow path of air supplied to injection device(s) 14 to effectuate the foundation heave correction described herein. As shown in FIG. 1, compressed air source 62 is upstream from dry air source 66. In other embodiments, a compressed air source (e.g., 62) can be downstream from a dry air source (e.g., 66).

As shown, system 10 can include an aftercooler 68 (e.g., air-cooled or water-cooled) between compressed air source 62 and dry air source 66 to provide additional drying and/or cooling to the air in the system. Aftercooler 68 may be configured to reduce the amount of water vapor in the air supplied from compressed air source 62 by condensing water vapor into liquid form and separating the liquid from the remaining gaseous air. As shown in FIG. 1, aftercooler 68 is a component separate from compressed air source 62 and dry air source 66. In some embodiments, at least one or both of a compressed air source (e.g., 62) and a dry air source (e.g., 66) can comprise an aftercooler (e.g., 68). In some such embodiments, a standalone aftercooler (e.g., 68) is optional.

In some embodiments, system 10 may include a heat source 70. Heat source 70 may be configured to heat air that is supplied to air injection device(s) 14 to a temperature such that, when the air is delivered to formation 16 via the air injection device(s) 14, moisture in the formation evaporates and the expanded portion of the formation shrinks. Heat source 70 can be configured to output air at a temperature that is greater than or equal to approximately any one of, or between approximately any two of: 100, 110, 120, 130, 140, 150, 160, 170, 180, 190, 200, 210, or 220 degrees Fahrenheit (° F.). Heat source 70 can comprise any suitable device or system for heating the air at the temperatures described herein, such as, for example, an inline heater, heat torch, forced air heater, drum heater, coil heater and/or the like.

In some embodiments, system 10 may include a control system 74 configured to control one or more components of the system, such as controlling the compression, drying, aftercooling and/or heating air. For example, control system 74 may be able to initiate operation(s) of compressed air source 62, dry air source 66, aftercooler 68, heat source 70, and/or other components of system 10, to perform the functions of the system as described herein.

Control system 74 may be physically or wirelessly coupled to one or more of the other components of system 10 and configured to control operation of the system via one or more user-initiated or automatic commands or parameters. In some embodiments, control system 74 may include a controller having a processor (e.g., a microcontroller/microprocessor, a central processing unit (CPU), a field-programmable gate array (FPGA) device, an application-specific integrated circuits (ASIC), another hardware device, a firmware device, or any combination thereof) and a memory (e.g., a computer-readable storage device) configured to store instructions, one or more thresholds, and one or more data sets, or the like. In some embodiments, control system may include one or more interface(s), one or more I/O device(s), a power source, one or more sensor(s), or combination thereof.

Each of dry air source 66, compressed air source 62, aftercooler 68, and/or heat source 70 can be customized and configured to provide air with a suitable characteristics to reduce the expansion areas of formation 16 according to the various types of strata or stratum in the formation and/or the climate in which the formation is located.

Figure 2:
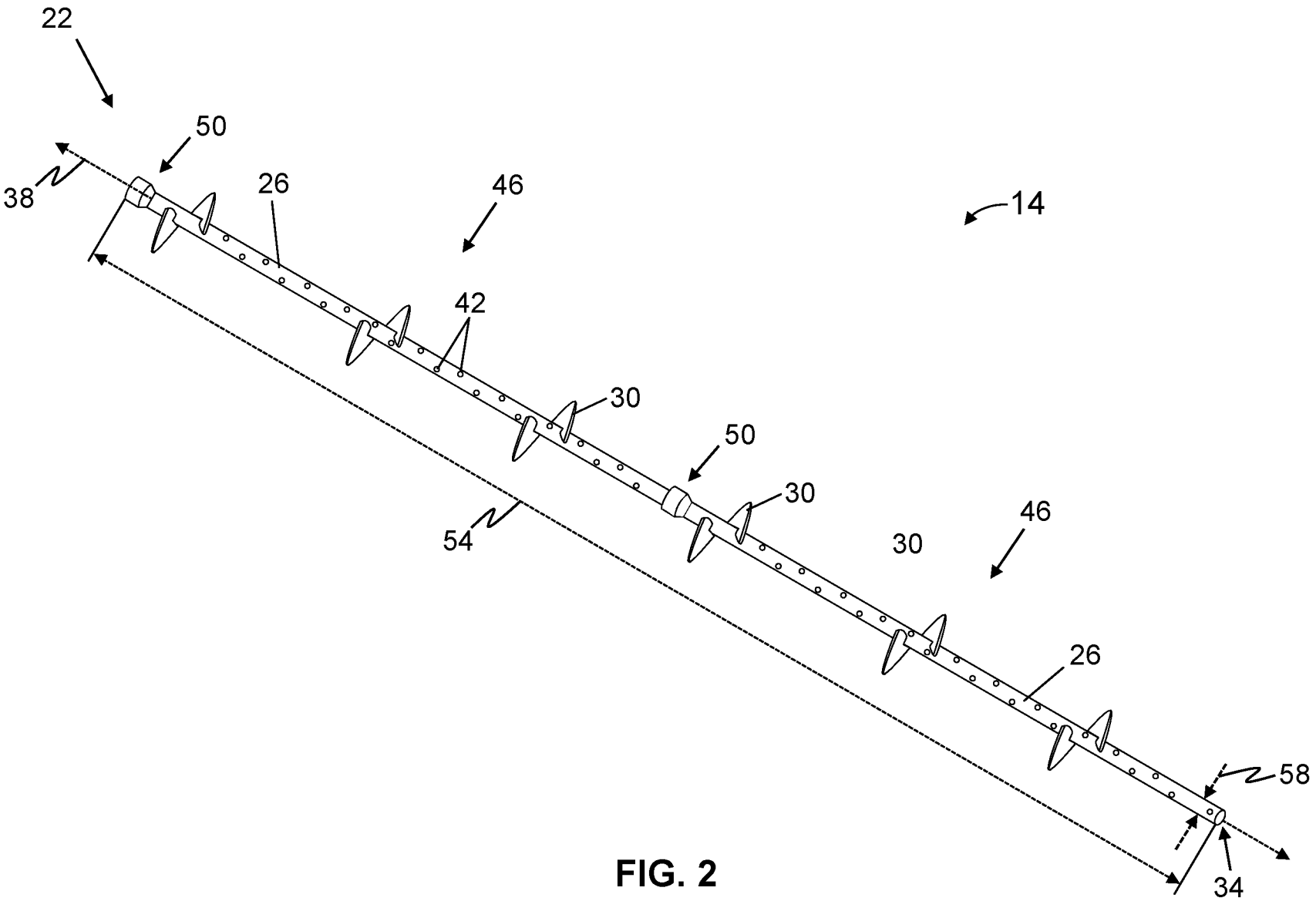
FIG. 2 is a perspective view of an example of an air injection device of the foundation repair system of FIG. 1.

Referring additionally to FIG. 2, shown therein is an exemplary embodiment of the present air injection device(s) 14. As shown, air injection device 14 includes an elongated body 22 configured to be disposed within formation 16. As discussed below, elongated body 22 may be coupled to one or more components of system 10 (e.g., compressed air source 62, dry air source 66, aftercooler 68, heat source 70) via one or more conduits to deliver air to formation 16. Elongated body 22 can be any suitable size and and/or shape (e.g., linear or arcuate) to access formation 16 underlying foundation 18. For example, elongated body 22 includes a length 54 measured between opposing ends of the elongated body along a longitudinal axis 38 of the body. Length 54 can be can be greater than or equal to approximately any one of, or between approximately any two of the following: 3, 4, 5, 6, 7, 8, 9, 10, 15, 20, 25, or 30 feet (ft.). In this way and others, elongated body 22 can be configured to reach any suitable area of soil expansion within formation 16 that is underlying foundation 18 to reduce the heave in the foundation. As shown, for example in FIG. 3, an upper end 55 of elongated body 22 may be positioned aboveground while a lower end 56 of the elongated body can be positioned within formation 16. Upper end 55 of elongated body 22 can be configured to be coupled to one or more components of system 10 (e.g., compressed air source 62, dry air source 66, aftercooler 68, heat source 70) to deliver air to formation 16.

Referring again to FIG. 2, in the depicted embodiment, elongated body 22 includes a sidewall 26 extending along a longitudinal axis 38 of the body. Elongated body 22 may comprise any suitable material to withstand insertion into the formation, including, but not limited to, a metal (e.g., steel), high-strength plastic, composite material, and/or the like. As shown, device 14 can include one or more helical blades 30 coupled to or unitary with sidewall 26 such that elongated body 22 may be driven (e.g., drilled or rotated) into formation 16.

In this embodiment, sidewall 26 defines a conduit 34 that extends along longitudinal axis 38 of elongated body 22. Conduit 34 may be configured to be in fluid communication with one or more components of system 10 (e.g., compressed air source 62, dry air source 66, aftercooler 68, heat source 70) to deliver air to formation 16. As shown, sidewall 26 includes a plurality of perforations 42 each extending through the sidewall. For example, conduit 34 may be defined by an inner surface of sidewall 26 and, in some embodiments, each perforation 42 may extend (e.g., radially away from longitudinal axis 38) from the inner surface of sidewall 26 to an outer surface of the sidewall. One or more perforations 42 may be in fluid communication with conduit 34 in order to permit air within the conduit to exit elongated body 22 through the perforation(s). Accordingly, injection device 14 may deliver air to portions of the formation (e.g., 16) that are underlying foundation 18 via perforations 42 to reduce moisture and alleviate expansion forces in the formation.

In the depicted embodiments, conduit 34 and perforations 42 include a circular cross section (e.g., cylindrical), however, the conduit and perforations 42 may include any suitable shape. For example, such configurations may include, but are not limited to, a uniform or non-uniform (e.g., tapered) cross-section having a triangular, rectangular, square, hexagonal, or otherwise polygonal, circular, elliptical, or otherwise rounded cross-sectional shape. Conduit 34 and/or perforations 42 may be shaped and sized to control air flow and optimize the amount of air delivered to formation 16. For example, conduit 34 may include a maximum transverse dimension 58 (e.g., diameter), measured from opposing sides of an inner surface of sidewall 26 along a straight line, that is greater than or equal to approximately any one of, or between approximately any two of the following: 0.125, 0.25, 0.375, 0.5, 0.625, 0.875, 1.0, 2.0, 2.5, 3.0, 3.5, 4.0, 5.0, 6.0, 7.0, 8.0, 9.0, 10.0, or 12.0 inches (in.). Conduit 34 may comprise a uniform maximum transverse diameter or a maximum transverse diameter that changes (e.g., decreases) from a proximal end configured to be near surface and a distal end configured to be beneath foundation 18. In some embodiments, a ratio of length 54 to maximum transverse dimension 58 is greater than or equal to approximately any one of, or between approximately any two of the following: 10, 50, 100, 200, or 300. In this way and others, air flow through conduit 34 and/or perforations 42 may be further controlled and directed into formation 16. In some embodiments, perforations 42 are distributed within sidewall 26 in a pattern (e.g., axially-aligned, laterally aligned, and/or helical) to deliver air to a desired portion of formation 16.

In the embodiment depicted in FIG. 2, elongated body 22 can comprise one or more segments each coupleable to one another other to define sidewall 26. As shown, elongated body 22 includes two segments (e.g., 46) that are coupled together to define sidewall 26 of elongated body 22. In some embodiments, an elongated body (e.g., 22) can comprise three or more segments (e.g., 46) coupleable together to define a sidewall (e.g., 26). Each segment 46 can defines a portion of conduit 34. As shown, a first segment 46 may be similar to another one of the segments (e.g., 46). Alternatively, a combination of dissimilar segments 46 can be arranged to direct air into formation 16 in any suitable fashion. As an illustrative example, an upper segment (e.g., segment 46 closest to the air supply) may include fewer perforations 42 than a downstream segment in order to increase the delivery of air to a lower portion of air injection device 14. In this manner, air injection device 14 may be configured for a particular application based on geology (e.g., soil characteristics), geography, climate, temperature, and/or the like.

In some embodiments, at least one segment (e.g., 46) may include an attachment portion 50. Attachment portion 50 may be sized to receive an end of an adjacent segment (e.g., 46). To illustrate, attachment portion 50 may enable each segment 46 to be releasably coupled to one other segment of sidewall 26 by, for example, threads, one or more fasteners (e.g., bolts, fittings, couplings, twist locks, and/or the like), adhesives, and/or the like. Additionally or alternatively, attachment portion 50 may enable elongated body 22 to be coupled to a source of air (e.g., via one or more conduits). In this way and others, air injection device 14 may be more easily assembled and disassembled for quick and efficient storage and transportation.

Figure 3:
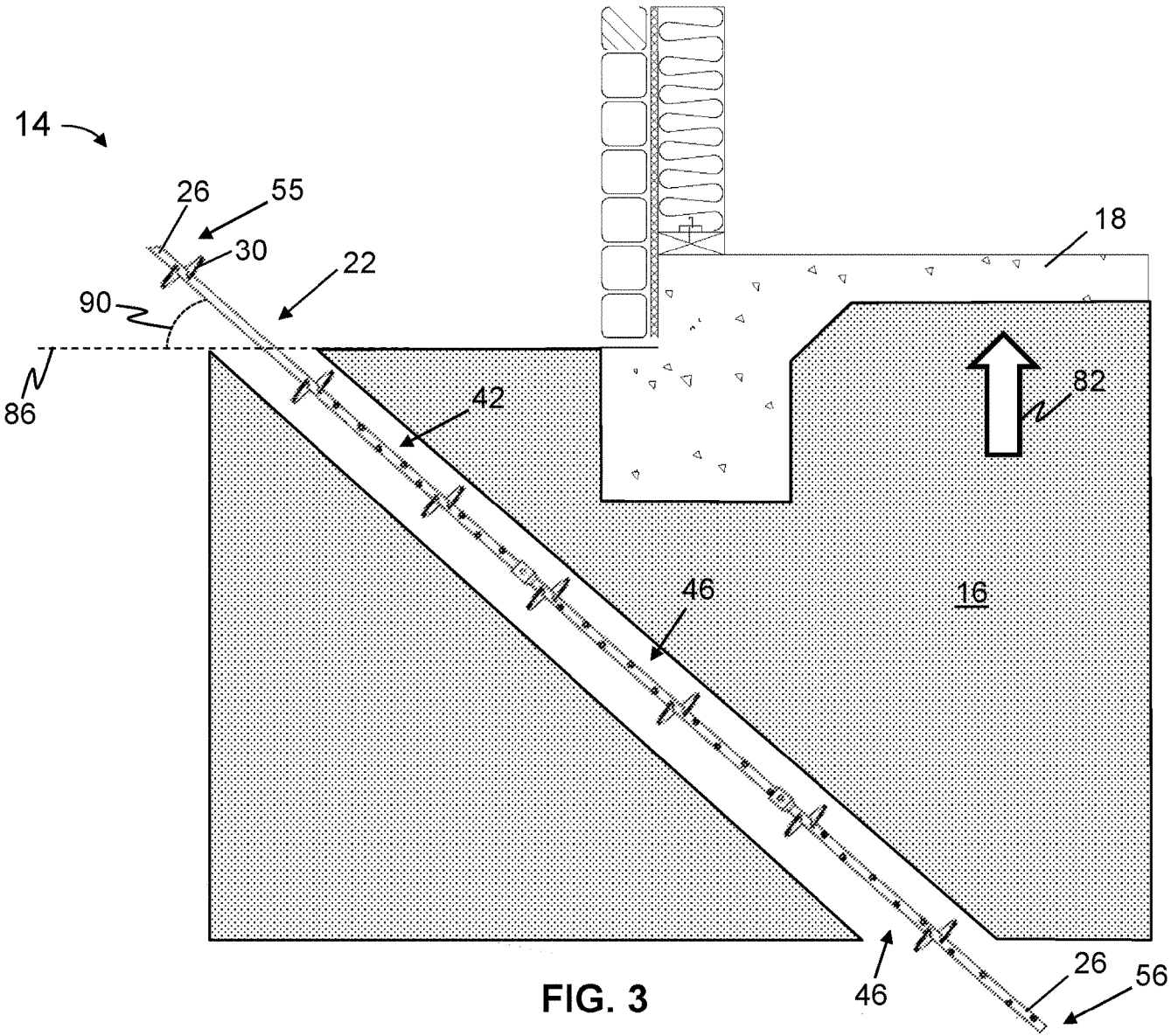
FIG. 3 is a side view of the air injection device of FIG. 2, shown positioned in soil that underlies a foundation of a structure, the soil, foundation, and structure shown in a cross-section view.

Referring to FIG. 3, as shown, injection device 14 may be inserted proximate to or into an expansive soil region that is exhibiting an upward heaving force 82 against foundation 18. As depicted, elongated body 22 may be angularly disposed relative to a plane 86 (e.g., horizontal plane) that is parallel to a top surface (e.g., ground surface) of formation 16 by an angle 90 defined by the smallest angle between the plane and longitudinal axis 38 of the body. In some embodiments, angle 90 is greater than or equal to any one of, or between any two of: 5, 15, 25, 35, 45, 55, 65, or 70 degrees. In this way and others, injection device 14 can be positioned under (e.g., vertically below) foundation 18. Any suitable number of injection devices 14 can be inserted along a perimeter of foundation 18 to deliver air to formation 16 and correct foundation heave. Such injection devices 14 can be inserted into formation 16 at any suitable distance from foundation 18. For example, injection devices 14 may be inserted into formation 16 at an insertion site that is less than approximately 50 feet (e.g., between approximately 1 and 30 feet, such as, for example, between approximately 5 and 15 feet) from foundation 18, as measured by the shortest distance between the insertion site and the foundation. Accordingly, one or more injection devices 14 can be configured to reach the most problematic areas beneath foundation 18 and deliver air (having the specific characteristics disclosed herein).

In some embodiments, after a suitable air is injected into formation 16 and heaving force 82 exerted on foundation 18 is reduced, injection device 14 may be configured to delivery one or more other fluids to formation 16. For example, system 10 can comprise a stabilizing agent source 73 configured to supply a stabilizing agent into conduit 34 of injection device 14. Such a stabilizing agent can then be delivered to formation 16 via perforations 42 (as described herein in relation to air delivery). Stabilizing agent may be configured to reduce absorption characteristics of the soil to prevent future foundation heave. Stabilizing agent source 73 can be configured to supply any suitable stabilizing agent to formation 16 via injection device(s) 14, such as, for example, enzymes, chemical compounds (e.g., magnesium chloride, calcium oxide, calcium hydroxide, and/or the like), lime, any suitable potassium-based solution, fly ash, cement, polymers (e.g., biopolymers, synthetic polymers, or the like), resins, or any suitable combination thereof. In some embodiments, such a stabilizing agent may be supplied to injection device 14 in combination with air from one or more system 10 components (e.g., compressed air source 62, dry air source 66, aftercooler 68, heat source 70), as described above. In this way and others, the air, the stabilizing agent, and/or other suitable fluid, can be delivered to formation 16 without connecting additional components or disconnect components of system 10.

Figure 4:
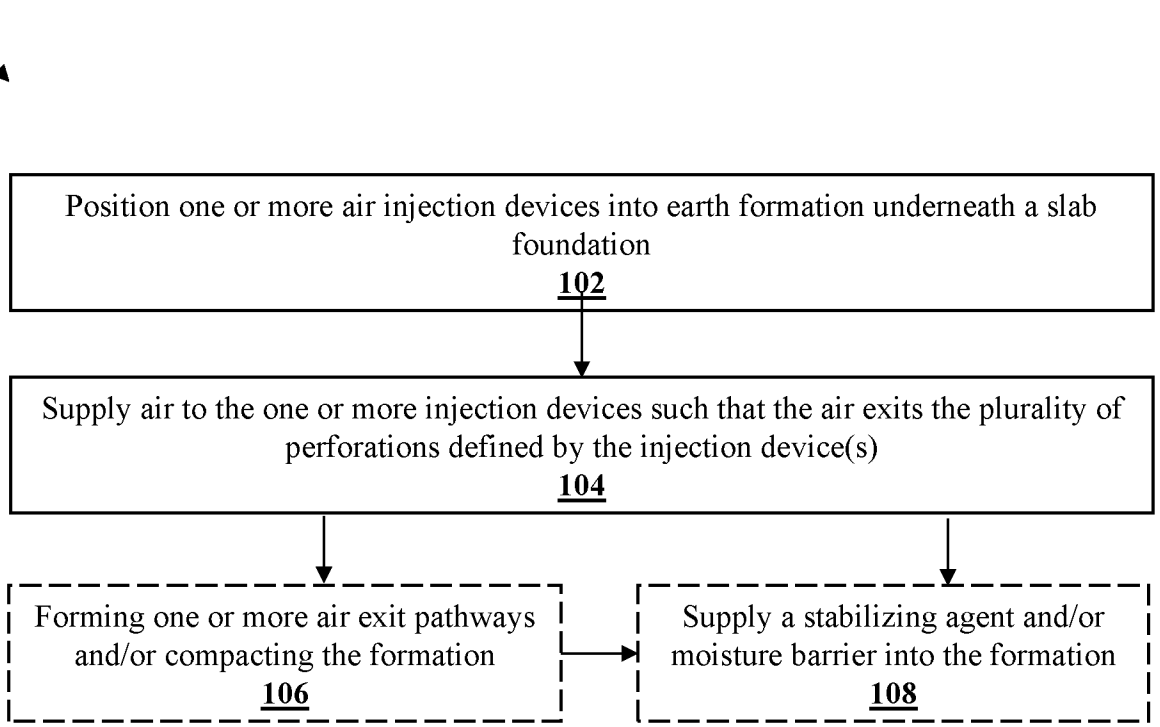
FIG. 4 illustrates a flow diagram of an example of a method of reducing foundation heave.

FIG. 4 depicts a flowchart of a methodology 101 for correcting foundation heave using the system 10 described above and depicted in FIG. 1. The methodology can be implemented manually or in an automated or semi-automated fashion via processor 74. In the depicted example, a step 102 involves positioning one or more air injection devices (e.g., 14) into formation 16 underneath a slab foundation (e.g., 18). For example, such a step may comprise positioning one or more air injection devices (e.g., 14) around a perimeter of foundation 18. More particularly, the methodology may comprise inserting air injection device(s) 14 within 10 feet (or any other suitable distance described herein) of a perimeter of the slab foundation. In some methodologies, positioning one or more air injection devices 14 can comprise inserting the one or more air injection devices at least three feet beneath foundation 18. Step 102 can comprise inserting air injection device(s) 14 into formation 16 at an angle 90 (as described herein) relative to a plane parallel to a top surface (e.g., ground surface) of the formation. In some methods, step 102 comprises rotating air injection device(s) 14 to drive the devices deeper within the formation (in embodiments where the devices have blades 30).

After air injection device(s) 14 are inserted into formation 16, air is supplied to the one or more injection devices at step 104 such that the air exits perforations 42 defined by the injection device(s). In some such methods, the air includes a relative humidity that is less than or equal to 5.0 percent. Step 104 can comprise supplying air having a relative humidity that is less than or equal to 1.5 percent. Step 104 can comprise supplying air that is heated by heat source 70 (to one or more of the temperatures disclosed herein). Step 104 can comprise supplying air that is compressed by compressed air source 62 (to one or more of the gauge pressures disclosed herein).

In some methods, after supplying air according to step 104, the method includes forming air exit pathways, at step 106. For example, such air exit pathways can be formed in formation 16, in foundation 18 itself, or in both. In some methods, air exit pathways may be drilled into formation 16 in order to provide an escape path for air under foundation 18. In some geographic regions, formation 16 can comprise high concentrations of radon and, as such, appropriate precautions must be taken to prevent unacceptable levels of radon to enter the structure above foundation 18 via the drilled air exit pathways. In such instances, air discharged from the drilled air exit pathways in foundation 18 may directed (e.g., by a duct) to discharge outside of the affected structure.

Additionally, or alternatively, step 106 may include compressing the formation (e.g., 16) in order to consolidate soil around a perimeter of foundation 18 such that a height of the foundation at the perimeter decreases and/or later air flow around the foundation is restricted by the consolidated soil. In this way and others, step 106 may enhance drying (e.g., shrinking) of the formation to efficiently reduce foundation heave.

In some methods, after supplying air according to step 104, the method includes supplying a stabilizing agent and/or moisture barrier to formation 16, at step 108. For example, any suitable stabilizing agent as disclosed herein can be supplied to one or more injection devices 14 such that the stabilizing agent exits the plurality of perforations 42 defined by the injection device. Step 108 may include inserting a moisture barrier within formation 16. Moisture barrier may be inserted either vertically or horizontally to prevent further foundation heave. In some embodiments, moisture barrier may comprise a plastic (e.g., geomembrane) liner, concrete, and/or the like. In some methods, after supplying air according to step 104, the method includes forming air exit pathways, at step 106 and then supplying a stabilizing agent and/or moisture barrier to formation 16, at step 108, as shown in FIG. 4.

System 10 can be configured to supply air to formation 16 as disclosed herein using any suitable combination of components disclosed herein (e.g., compressed air source 62, dry air source 66, aftercooler 68, heat source 70) and configured and arranged in any suitable sequential order. For example, in some embodiments, a system (e.g., 10) can comprise, in the following order, a compressed air source (e.g., 62), an aftercooler (e.g., 68) (either as a standalone component or as part of the compressed air source), and a heat source (e.g., 70) to supply air to a formation (e.g., 16) via one or more injection devices (e.g., 14) as disclosed herein. For further example, in some embodiments, a system (e.g., 10) can comprise, in the following order, a compressed air source (e.g., 62), an aftercooler (e.g., 68) (either as a standalone component or as part of the compressed air source), a dry air source (e.g., 66), and a heat source (e.g., 70) to supply air to a formation (e.g., 16) via one or more injection devices (e.g., 14) as disclosed herein. For yet further example, in some embodiments, a system (e.g., 10) can comprise, in the following order, a compressed air source (e.g., 62), an aftercooler (e.g., 68) (either as a standalone component or as part of the compressed air source), and a dry air source (e.g., 66) to supply air to a formation (e.g., 16) via one or more injection devices (e.g., 14) as disclosed herein. For yet even further example, in some embodiments, a system (e.g., 10) can comprise, in the following order, a compressed air source (e.g., 62) and an aftercooler (e.g., 68) (either as a standalone component or as part of the compressed air source) to supply air to a formation (e.g., 16) via one or more injection devices (e.g., 14) as disclosed herein.

The systems and processes described herein can also include various equipment that is not shown and is known to one of skill in the art. For example, some controllers, piping, tubing, valves, pumps, heaters, thermocouples, pressure indicators, mixers, heat exchangers, and the like may not be shown.

EXAMPLES

As part of the disclosure of the present invention, specific examples are included below. The examples are for illustrative purposes only and are not intended to limit the invention. Those of ordinary skill in the art will readily recognize parameters that can be changed or modified to yield essentially the same results.

Example 1

An analysis of the air used in an exemplary system (e.g., 10) was performed to show the various characteristics of the air as it passed through the system. The exemplary system (e.g., 10) in this example included, in series, a compressor (e.g., compressed air source 62), an aftercooler (e.g., 68), and a desiccant dryer (e.g., dry air source 66) in fluid communication to deliver air to an injection device (e.g., 14) disposed within a formation (e.g., 16). Air characteristics were recorded at five separate locations of the system and the results are illustrated in Table 1 below.

TABLE 1

| | Compressor Inlet | Compressor Outlet | Aftercooler Outlet | Desiccant Dryer Outlet | System Outlet (Relative to Atmospheric Discharge) |
|---|---|---|---|---|---|
| Volume | 8 cu. Ft. | 1 cu. Ft. | 1 cu. ft. | 1 cu ft. | 8 cu ft. |
| Pressure (gauge) | 0 psig | 100 psig | 100 psig | 100 psig | 0 psig |
| Temperature (example) | 68° F. | 158° F. | 68° F. | 75° F. | 70° F. |
| Water Content (vapor) | 2.1 g | 2.1 g | 0.6 g | 0.003 g | 0.003 g |
| Relative Humidity | 50% | 30% | 100% | 0.4% | 0.1% |
| Dew Point (at pressure shown) | 50° F. | 97° F. | 68° F. | −40° F. | −70° F. |

As illustrated in Table 1, air (e.g., ambient air) was introduced into an inlet of the compressor at local atmospheric conditions. Temperature, pressure, and humidity of the air introduced to the compressor may vary by climate, weather, or other meteorological factors, and it should be known that operational parameters of the system (e.g., 10) may be optimized based on the ambient air. The air within the compressor was pressurized to 100 psig at an outlet thereof. As shown in Table 1, the relative humidity of the air decreased due to the increase in temperature from pressurizing the air, however the water content of air remained the same.

Then, the air from the compressor was delivered to the aftercooler downstream of the compressor outlet. The aftercooler cooled the compressed air from the outlet of the compressor and condensed the water vapor in the compressed air. The condensed water vapor turned to liquid and the resulting separated gaseous air exited the outlet of the aftercooler. As shown, the water content was reduced from 2.1 grams to 0.6 grams between the outlet of the compressor and the outlet of the aftercooler and the relative humidity of the air changed from 30% to 100%. The air from the aftercooler was then supplied to a desiccant dyer that included a plurality of desiccant beads disposed within a housing. As the compressed air was forced through the housing to the desiccant dryer outlet by the compressor, the desiccant beads reacted with the air to remove moisture therefrom. As shown in Table 1, the desiccant dryer removed enough water content such that the dew point decreased from 68° F. at the aftercooler outlet to −40° F. at the desiccant outlet. As shown in Table 1, the air exhibited 0.4% relative humidity at the desiccant outlet The air from the desiccant dryer was then delivered downstream to injection device 14 and delivered to the formation as discussed herein. Accordingly, the system was used to deliver air having (as measured relative to an atmospheric discharge) a relative humidity that was less than 1% and a temperature that is greater than 70° F. to an area of high soil expansion, thus, shrinking the soil and alleviating expansion forces acting on the foundation.

Example 2

An additional analysis of the air used in an exemplary system (e.g., 10) was performed to show the various characteristics of the air as it passed through the system. The exemplary system (e.g., 10) in this example included, in series, a compressor (e.g., compressed air source 62), an aftercooler (e.g., 68), and a refrigerated dryer (e.g., dry air source 66) in fluid communication to deliver air to an injection device (e.g., 14) disposed within a formation (e.g., 16). Air characteristics were recorded at five separate locations of the system and the results are illustrated in Table 2 below.

TABLE 2

| | Compressor Inlet | Compressor Outlet | Aftercooler Outlet | Refrigerated Dryer Outlet | System Outlet (Relative to Atmospheric Discharge) |
|---|---|---|---|---|---|
| Volume | 8 cu. Ft. | 1 cu. Ft. | 1 cu. ft. | 1 cu ft. | 8 cu ft. |
| Pressure (gauge) | 0 psig | 100 psig | 100 psig | 100 psig | 0 psig |
| Temperature (example) | 68° F. | 158° F. | 68° F. | 38° F. | 34° F. |
| Water Content (vapor) | 2.1 g | 2.1 g | 0.6 g | 0.2 g | 0.2 g |
| Relative Humidity | 50% | 30% | 100% | 100% | 11% |
| Dew Point (at pressure shown) | 50° F. | 97° F. | 68° F. | 38° F. | −8° F. |

As illustrated in Table 2, air (e.g., ambient air) was introduced into an inlet of the compressor at local atmospheric conditions. Temperature, pressure, and humidity of the air introduced to the compressor may vary by climate, weather, or other meteorological factors, and it should be known that operational parameters of the system (e.g., 10) may be optimized based on the ambient air. The air within the compressor was pressurized to 100 psig at an outlet thereof. As shown in Table 2, the relative humidity of the air decreased due to the increase in temperature from pressurizing the air, however the water content of air remained the same.

Then, the air from the compressor was delivered to the aftercooler. The aftercooler cooled the compressed air from the outlet of the compressor and condensed the water vapor in the compressed air. As shown, the water content was reduced from 2.1 grams to 0.6 grams between the outlet of the compressor and the outlet of the aftercooler and the relative humidity of the air changed from 30% to 100%. The air from the aftercooler was then supplied to the refrigerated dryer. As shown in Table 2, the refrigerated dryer removed enough water content such that the dew point decreased from 68° F. at the aftercooler outlet to 38° F. at the refrigerated dryer outlet.

The air from the refrigerated dryer was then delivered downstream to injection device 14 and delivered to the formation as discussed herein. Accordingly, the system was used to deliver air having (as measured relative to an atmospheric discharge) a relative humidity that was 11% and a temperature of 34° F. to an area of high soil expansion, thus, shrinking the soil and alleviating expansion forces acting on the foundation.

Example 3

An additional analysis of the air used in an exemplary system (e.g., 10) was performed to show the various characteristics of the air as it passed through the system. The exemplary system (e.g., 10) in this example included, in series, a compressor (e.g., compressed air source 62), an aftercooler (e.g., 68), and an inline heater (e.g., heat source 70) in fluid communication to deliver air to an injection device (e.g., 14) disposed within a formation (e.g., 16). Air characteristics were recorded at five separate locations of the system and the results are illustrated in Table 3 below.

TABLE 3

| | Compressor Inlet | Compressor Outlet | Aftercooler Outlet | Heater Outlet | System Outlet (Relative to Atmospheric Discharge) |
|---|---|---|---|---|---|
| Volume | 8 cu. Ft. | 1 cu. Ft. | 1 cu. ft. | 1 cu ft. | 8 cu ft. |
| Pressure (gauge) | 0 psig | 100 psig | 100 psig | 100 psig | 0 psig |
| Temperature (example) | 68° F. | 158° F. | 68° F. | 150° F. | 145° F. |
| Water Content (vapor) | 2.1 g | 2.1 g | 0.6 g | 0.6 g | 0.6 g |
| Relative Humidity | 50% | 30% | 100% | 9.1% | 1.3% |
| Dew Point (at pressure shown) | 50° F. | 97° F. | 68° F. | 68° F. | 17° F. |

As illustrated in Table 3, air (e.g., ambient air) was introduced into an inlet of the compressor at local atmospheric conditions. Temperature, pressure, and humidity of the air introduced to the compressor may vary by climate, weather, or other meteorological factors, and it should be known that operational parameters of the system (e.g., 10) may be optimized based on the ambient air. The air within the compressor was pressurized to 100 psig at an outlet thereof. As shown in Table 3, the relative humidity of the air decreased due to the increase in temperature from pressurizing the air, however the water content of air remained the same.

Then, the air from the compressor was delivered to the aftercooler. The aftercooler cooled the compressed air from the outlet of the compressor and condensed the water vapor in the compressed air. As shown, the water content was reduced from 2.1 grams to 0.6 grams between the outlet of the compressor and the outlet of the aftercooler and the relative humidity of the air changed from 30% to 100%. The air from the aftercooler was then supplied to the heater. The heater further decreased the relative humidity of the air by increasing the temperature of the air. As shown in Table 3, the heater removed enough water content such that the air exhibited 9.1% relative humidity at the heater outlet.

The air from the heater was then delivered downstream to injection device 14 and delivered to the formation as discussed herein. As the air was delivered through injection device 14, the air cooled slightly and its relative humidity reduced further. Accordingly, the system was used to deliver air having (as measured relative to an atmospheric discharge) a relative humidity that was 1.3% and a temperature of 145° F. to an area of high soil expansion, thus, shrinking the soil and alleviating expansion forces acting on the foundation.

Example 4

An additional analysis of the air used in an exemplary system (e.g., 10) was performed to show the various characteristics of the air as it passed through the system. The exemplary system (e.g., 10) in this example included, in series, a compressor (e.g., compressed air source 62), an aftercooler (e.g., 68), a refrigerated dryer (e.g., dry air source 66), and an inline heater (e.g., heat source 70) in fluid communication to deliver air to an injection device (e.g., 14) disposed within a formation (e.g., 16). Air characteristics were recorded at six separate locations of the system and the results are illustrated in Table 4 below.

TABLE 4

| Volume | Compressor Inlet 8 cu. Ft. | Compressor Outlet 1 cu. Ft. | Aftercooler Outlet 1 cf. ft. | Refrigerated Dryer Outlet 1 cf ft. | Heater Outlet 1 cu ft. | System Outlet (Relative to Atmospheric Discharge) 8 cu ft. |
|---|---|---|---|---|---|---|
| Pressure (gauge) | 0 psig | 100 psig | 100 psig | 100 psig | 100 psig | 0 psig |
| Temperature (example) | 68° F. | 158° F. | 68° F. | 38° F. | 150° F. | 145° F. |
| Water Content (vapor) | 2.1 g | 2.1 g | 0.6 g | 0.2 g | 0.2 g | 0.2 g |
| Relative Humidity | 50% | 30% | 100% | 100% | 3% | 0.4% |
| Dew Point (at pressure shown) | 50° F. | 97° F. | 68° F. | 38° F. | 38° F. | −8° F. |

As illustrated in Table 4, air (e.g., ambient air) was introduced into an inlet of the compressor at local atmospheric conditions. Temperature, pressure, and humidity of the air introduced to the compressor may vary by climate, weather, or other meteorological factors, and it should be known that operational parameters of the system (e.g., 10) may be optimized based on the ambient air. The air within the compressor was pressurized to 100 psig at an outlet thereof. As shown in Table 4, the relative humidity of the air decreased due to the increase in temperature from pressurizing the air, however the water content of air remained the same.

Then, the air from the compressor was delivered to the aftercooler. The aftercooler cooled the compressed air from the outlet of the compressor and condensed the water vapor in the compressed air. As shown, the water content was reduced from 2.1 grams to 0.6 grams between the outlet of the compressor and the outlet of the aftercooler and the relative humidity of the air changed from 30% to 100%. The air from the aftercooler was then supplied to the refrigerated dryer. As shown in Table 4, the refrigerated dryer removed enough water content such that the dew point decreased from 68° F. at the aftercooler outlet to 38° F. at the refrigerated dryer outlet.

The air from the refrigerated dryer was then supplied to the heater. The heater decreased the relative humidity of the air by increasing the temperature of the air. As shown in Table 4, the heater removed enough water content such that the air exhibited 3% relative humidity at the heater outlet.

The air from the heater was then delivered downstream to injection device 14 and delivered to the formation as discussed herein. As the air was delivered through injection device 14, the air cooled slightly and its relative humidity reduced further. Accordingly, the system was used to deliver air having (as measured relative to an atmospheric discharge) a relative humidity that was 0.4% and a temperature of 145° F. to an area of high soil expansion, thus, shrinking the soil and alleviating expansion forces acting on the foundation.

Example 5

An additional analysis of the air used in an exemplary system (e.g., 10) was performed to show the various characteristics of the air as it passed through the system. The exemplary system (e.g., 10) in this example included, in series, a compressor (e.g., compressed air source 62) and an aftercooler (e.g., 68) in fluid communication to deliver air to an injection device (e.g., 14) disposed within a formation (e.g., 16). Air characteristics were recorded at four separate locations of the system and the results are illustrated in Table 5 below.

TABLE 5

| | Compressor Inlet | Compressor Outlet | Aftercooler Outlet | System Outlet (Relative to Atmospheric Discharge) |
|---|---|---|---|---|
| Volume | 8 cu. Ft. | 1 cu. Ft. | 1 cu. ft. | 8 cu ft. |
| Pressure (gauge) | 0 psig | 100 psig | 100 psig | 0 psig |
| Temperature (example) | 68° F. | 158° F. | 68° F. | 64° F. |
| Water Content (vapor) | 2.1 g | 2.1 g | 0.6 g | 0.6 g |
| Relative Humidity | 50% | 30% | 100% | 14.8% |
| Dew Point (at pressure shown) | 50° F. | 97° F. | 68° F. | 17° F. |

As illustrated in Table 5, air (e.g., ambient air) was introduced into an inlet of the compressor at local atmospheric conditions. Temperature, pressure, and humidity of the air introduced to the compressor may vary by climate, weather, or other meteorological factors, and it should be known that operational parameters of the system (e.g., 10) may be optimized based on the ambient air. The air within the compressor was pressurized to 100 psig at an outlet thereof. As shown in Table 5, the relative humidity of the air decreased due to the increase in temperature from pressurizing the air, however the water content of air remained the same.

Then, the air from the compressor was delivered to the aftercooler. The aftercooler cooled the compressed air from the outlet of the compressor and condensed the water vapor in the compressed air. As shown, the water content was reduced from 2.1 grams to 0.6 grams between the outlet of the compressor and the outlet of the aftercooler and the relative humidity of the air changed from 30% to 100%. The air from the aftercooler was then supplied to downstream to injection device 14 and delivered to the formation as discussed herein. As the air was delivered through injection device 14, the air cooled slightly and its relative humidity decreased. Accordingly, the system was used to deliver air having (as measured relative to an atmospheric discharge) a relative humidity that was 14.8% and a temperature of 64° F. to an area of high soil expansion, thus, shrinking the soil and alleviating expansion forces acting on the foundation.

The above specification and examples provide a complete description of the structure and use of illustrative configurations. Although certain configurations have been described above with a certain degree of particularity, or with reference to one or more individual configurations, those skilled in the art could make numerous alterations to the disclosed configurations without departing from the scope of this invention. As such, the various illustrative configurations of the methods and systems are not intended to be limited to the particular forms disclosed. Rather, they include all modifications and alternatives falling within the scope of the claims, and configurations other than the one shown may include some or all of the features of the depicted configurations. For example, elements may be omitted or combined as a unitary structure, connections may be substituted, or both. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one configuration or may relate to several configurations. Accordingly, no single implementation described herein should be construed as limiting and implementations of the disclosure may be suitably combined without departing from the teachings of the disclosure.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims. The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system for correcting foundation heave, the system comprising:

a compressed air source configured to propel air having a relative humidity that is less than or equal to 30 percent;

one or more air injection devices, at least one of which includes an elongated body configured to be disposed within an earth formation, the elongated body comprising:

a length that is greater than or equal to 3 feet; and a sidewall that defines:

a conduit extending along a longitudinal axis of the elongated body, the conduit configured to be in fluid communication with the compressed air source such that the conduit receives air propelled by the compressed air source; and a plurality of perforations, each extending through the sidewall and in fluid communication with the conduit;

an aftercooler in fluid communication with the one or more air injection devices and configured to cool air supplied to the conduit of the at least of the one or more injection devices; and a dry air source configured to be in fluid communication with the one or more air injection devices, the dry air source configured to reduce the relative humidity of air supplied to the conduit of the at least one of the one or more air injection devices, wherein the dry air source is configured to receive the cooled air supplied by the aftercooler and is configured to supply the air having the reduced relative humidity to the conduit of the at least one of the one or more injection devices.

2. The system of claim 1, wherein the relative humidity of the air propelled by the compressed air source is less than or equal to 5.0 percent.

3. The system of claim 1, wherein a ratio of the length of the elongated body to a maximum transverse dimension of the conduit is greater than or equal to 100.

4. The system of claim 1, wherein the at least one of the one or more air injection devices comprises one or more helical blades, each coupled to an outer surface of the sidewall of the elongated body.

5. The system of claim 1, wherein the aftercooler is configured to receive the air propelled by the compressed air source and is configured to supply the cooled air to the conduit of the at least one of the one or more injection devices.

6. The system of claim 1, comprising a heat source configured to be in fluid communication with the one or more air injection devices, the heat source configured to supply air having a temperature of at least 150 degrees Fahrenheit to the conduit of the at least one of the one or more air injection devices.

7. The system of claim 6, wherein the heat source is configured to receive the cooled air supplied by the aftercooler and is configured to supply the air having the temperature of at least 150 degrees Fahrenheit to the conduit of the at least one of the one or more injection devices.

8. The system of claim 1, wherein the heat source is configured to receive from the dry air source the air having the reduced relative humidity and is configured to supply the air having the temperature of at least 150 degrees Fahrenheit to the conduit of the at least one of the one or more injection devices.

9. The system of claim 1, comprising a stabilizing agent source in fluid communication with the one or more air injection devices and configured to supply a stabilizing agent to reduce absorption characteristics of soil to prevent foundation heave.

10. A system for correcting foundation heave, the system comprising:

a compressed air source configured to propel air having a relative humidity that is less than or equal to 30 percent;

one or more air injection devices, at least one of which includes an elongated body configured to be disposed within an earth formation, the elongated body comprising:

a length that is greater than or equal to 3 feet; and a sidewall that defines:

a conduit extending along a longitudinal axis of the elongated body, the conduit configured to be in fluid communication with the compressed air source such that the conduit receives air propelled by the compressed air source; and a plurality of perforations, each extending through the sidewall and in fluid communication with the conduit;

an aftercooler in fluid communication with the one or more air injection devices and configured to cool air supplied to the conduit of the at least of the one or more injection devices;

a dry air source configured to be in fluid communication with the one or more air injection devices, the dry air source configured to reduce the relative humidity of air supplied to the conduit of the at least one of the one or more air injection devices;

a heat source configured to be in fluid communication with the one or more air injection devices, the heat source configured to supply air having a temperature of at least 150 degrees Fahrenheit to the conduit of the at least one of the one or more air injection devices.

11. The system of claim 10, wherein the relative humidity of the air propelled by the compressed air source is less than or equal to 5.0 percent.

12. The system of claim 10, wherein a ratio of the length of the elongated body to a maximum transverse dimension of the conduit is greater than or equal to 100.

13. The system of claim 10, wherein the at least one of the one or more air injection devices comprises one or more helical blades, each coupled to an outer surface of the sidewall of the elongated body.

14. The system of claim 10, wherein the aftercooler is configured to receive the air propelled by the compressed air source and is configured to supply the cooled air to the conduit of the at least one of the one or more injection devices.

15. The system of claim 10, wherein the dry air source is configured to receive the cooled air supplied by the aftercooler and is configured to supply the air having the reduced relative humidity to the conduit of the at least one of the one or more injection devices.

16. The system of claim 10, wherein the heat source is configured to receive the cooled air supplied by the aftercooler and is configured to supply the air having the temperature of at least 150 degrees Fahrenheit to the conduit of the at least one of the one or more injection devices.

17. The system of claim 10, wherein the heat source is configured to receive from the dry air source the air having the reduced relative humidity and is configured to supply the air having the temperature of at least 150 degrees Fahrenheit to the conduit of the at least one of the one or more injection devices.

18. The system of claim 10, comprising a stabilizing agent source in fluid communication with the one or more air injection devices and configured to supply a stabilizing agent to reduce absorption characteristics of soil to prevent foundation heave.

19. A system for correcting foundation heave, the system comprising:

a compressed air source configured to propel air having a relative humidity that is less than or equal to 30 percent;

one or more air injection devices, at least one of which includes an elongated body configured to be disposed within an earth formation, the elongated body comprising:

a length that is greater than or equal to 3 feet; and a sidewall that defines:

a conduit extending along a longitudinal axis of the elongated body, the conduit configured to be in fluid communication with the compressed air source such that the conduit receives air propelled by the compressed air source; and a plurality of perforations, each extending through the sidewall and in fluid communication with the conduit;

a stabilizing agent source in fluid communication with the one or more air injection devices and configured to supply a stabilizing agent to reduce absorption characteristics of soil to prevent foundation heave;

an aftercooler in fluid communication with the one or more air injection devices and configured to cool air supplied to the conduit of the at least of the one or more injection devices; and a heat source configured to be in fluid communication with the one or more air injection devices, the heat source configured to supply air having a temperature of at least 150 degrees Fahrenheit to the conduit of the at least one of the one or more air injection devices, wherein the heat source is configured to receive the cooled air supplied by the aftercooler and is configured to supply the air having the temperature of at least 150 degrees Fahrenheit to the conduit of the at least one of the one or more injection devices.

20. The system of claim 19, wherein the relative humidity of the air propelled by the compressed air source is less than or equal to 5.0 percent.

21. The system of claim 19, wherein a ratio of the length of the elongated body to a maximum transverse dimension of the conduit is greater than or equal to 100.

22. The system of claim 19, wherein the at least one of the one or more air injection devices comprises one or more helical blades, each coupled to an outer surface of the sidewall of the elongated body.

23. The system of claim 19, wherein the aftercooler is configured to receive the air propelled by the compressed air source and is configured to supply the cooled air to the conduit of the at least one of the one or more injection devices.

24. The system of claim 19, comprising a dry air source configured to be in fluid communication with the one or more air injection devices, the dry air source configured to reduce the relative humidity of air supplied to the conduit of the at least one of the one or more air injection devices.

25. The system of claim 24, wherein the dry air source is configured to receive the cooled air supplied by the aftercooler and is configured to supply the air having the reduced relative humidity to the conduit of the at least one of the one or more injection devices.

26. The system of claim 24, wherein the heat source is configured to receive from the dry air source the air having the reduced relative humidity and is configured to supply the air having the temperature of at least 150 degrees Fahrenheit to the conduit of the at least one of the one or more injection devices.

27. The system of claim 19, wherein the stabilizing agent source is in fluid communication with at least one of the compressed air source, the aftercooler, and the heat source such that the stabilizing agent is supplied in combination with air from the at least one of the compressed air source, the aftercooler, and the heat source.

* * * * *